United States Patent [19]

Wittmeier

[11] 4,088,072

[45] May 9, 1978

[54] CAN CRUSHER FOR REDUCING CANS OR SIMILAR CONTAINERS TO A COMPACT FORM

[76] Inventor: George F. Wittmeier, 15651 SE. 8th, Bellevue, Wash. 98008

[21] Appl. No.: 679,577

[22] Filed: Apr. 23, 1976

[51] Int. Cl.[2] ..... B30B 1/02

[52] U.S. Cl. ..... 100/283; 100/DIG. 2; 100/295; 100/293

[58] Field of Search ..... 100/DIG. 2, 293, 295, 100/214, 283, 261, 264, 280; 241/99

[56] References Cited

U.S. PATENT DOCUMENTS

| | | | |
|---|---|---|---|
| 232,029 | 9/1880 | Haile | 100/283 X |
| 2,008,592 | 7/1935 | Paxton | 100/60 X |
| 2,128,630 | 8/1938 | Wright | 100/DIG. 2 |
| 3,104,607 | 9/1963 | Galas | 100/DIG. 2 |
| 3,208,372 | 9/1965 | Taylor | 100/DIG. 2 |
| 3,732,804 | 5/1973 | Moller | 100/295 |
| 3,960,071 | 6/1976 | Mayer et al. | 100/293 |

*Primary Examiner*—Peter Feldman
*Attorney, Agent, or Firm*—David H. Deits; Roy E. Mattern, Jr.; Kenneth S. Kessler

[57] ABSTRACT

A can crusher, particularly suited to reducing cans or similar containers to a compact form by crushing the containers between a pair of opposed jaws. The crusher consists of a track which serves as a base for the crusher and a trolley which is attached to and slides along the track. A first plate transversely attached to the track forms the lower jaw. A second plate is attached to the trolley in juxtaposition with the lower jaw to form an upper jaw. A lower pair of parallel lever arms are pivotally attached at their lower ends to opposite sides of the lower jaw. An upper pair of parallel lever arms are each pivotally attached at a midpoint to the opposite sides of the upper jaw and pivotally attached at their lower ends to the upper ends of the corresponding lower pair of lever arms. A handle is attached to the upper end of the upper pair of lever arms to serve as an operating grip. A can is inserted between the jaws and the handle moved from a raised position, which causes the jaws to open widely, downward through an approximately 180° arc toward the lower jaw to bring the jaws together crushing the can. The faces of the jaws may contain bosses which serve to promote the buckling of the can surfaces.

10 Claims, 10 Drawing Figures

CAN CRUSHER FOR REDUCING CANS OR SIMILAR CONTAINERS TO A COMPACT FORM

BACKGROUND OF THE INVENTION

The invention relates to an apparatus for crushing containers, more particularly the device is particularly suited for crushing metal cans. It is adapted for manual operation.

Can crushers particularly suited for manual operation are illustrated by Alverez U.S. Pat. No. 2,446,898; Smith U.S. Pat. No. 2,563,379; and Griemert U.S. Pat. No. 3,009,414. Smith and Griemart both illustrate an apparatus in which the object to be crushed is placed on a horizontal base platform and from which a shaft arises vertically from the base upon which is mounted a crushing plate. A lever is attached to the vertical shaft and to the crushing plate through a second lever. The first lever is swung through a downward arc forcing the crushing plate against the base, crushing the interposed can.

Alverez describes a structure which is basically in the form of a box with open sides. The box surfaces are hinged at their intersections. The box collapses to crush the can placed inside the box, a lever being used to forcefully collapse the box.

The prior container crushers did not incorporate any adjustment to accommodate different sized cans while maintaining similar mechanical advantages for all. The can crusher disclosed is adjustable to increase the spectrum of container sizes which may be accommodated while maintaining a particular spectrum of mechanical advantage.

The mechanical advantage of the prior crushers did not change to reduce the amount of effort required to start and finish the crushing. The disclosed crusher has an increased mechanical advantage at the start and finish of the crushing operation as well as a long stroke to reduce the overall effort required.

The previously available crushers collapsed the containers to a thickness that depended on the force exerted whereas the disclosed crusher crushes the containers to a uniform thickness.

The prior devices did not, as this device does, have irregularities in the crushing jaws to induce buckling of the container surfaces nor an operating handle that is transversely mounted to the direction of its movement.

SUMMARY OF THE INVENTION

The container crusher is suitable for crushing various sizes and composition containers and reducing them into a flat form for disposal or other use. It is particularly suited to crushing metal cans by manual operation. The apparatus consists of a track which serves as a base for the can crusher and a guide member which is slidably attached to the track so that the guide member is able to travel along the track. A first plate is rigidly and transversely attached to the track to form a jaw of the crusher. A second plate is similarly aligned to the track but attached to the guide member in juxtaposition with the first plate. The two plates together form opposing jaws of the crusher. The jaws may be variably spaced by moving the second plate along the track. A first lever arm is to be attached to the first plate at its first end. A second lever arm is to be attached at a midpoint to the corresponding position on the second plate, and is also attached at its first end to the second end of the first lever arm. A handle is attached to the second end of the second lever to form an operating means.

To operate the device, the handle is placed in a position furthest from the first plate. A can is inserted between the jaws. In this position the jaws will be at their maximum opening. Upon insertion of the can the handle is swung downward through an arc toward the first plate. This causes the jaws to converge and crush the interposed can.

The crusher will operate in the same manner if the first plate is attached to the guide and the second plate is attached rigidly to the track.

It is particularly desirable to place bosses on the opposing surfaces of the plates. The bosses serve to promote the collapsing of the can walls and surfaces. To accommodate different diameter sized cans the boss is most desirably in the form of a cross centrally located on each plate face.

To prevent twisting of the apparatus it is desirable that the lever arms come in pairs. The pairs being attached to opposite sides of the plates.

DETAILED DESCRIPTION OF THE INVENTION

INTRODUCTION

It is often found to be desirable to crush empty containers such as cans prior to their storage or disposal to reduce the amount of space otherwise taken up. The container crusher shown and described is particularly well adapted to perform this function. It is particularly well suited for crushing cans and is conveniently suited for manual operation in the home, in a camper, or on a boat. It is capable of reducing cans to approximately twenty percent of their original volume.

AN EMBODIMENT OF THE CAN CRUSHER

Figure 1:
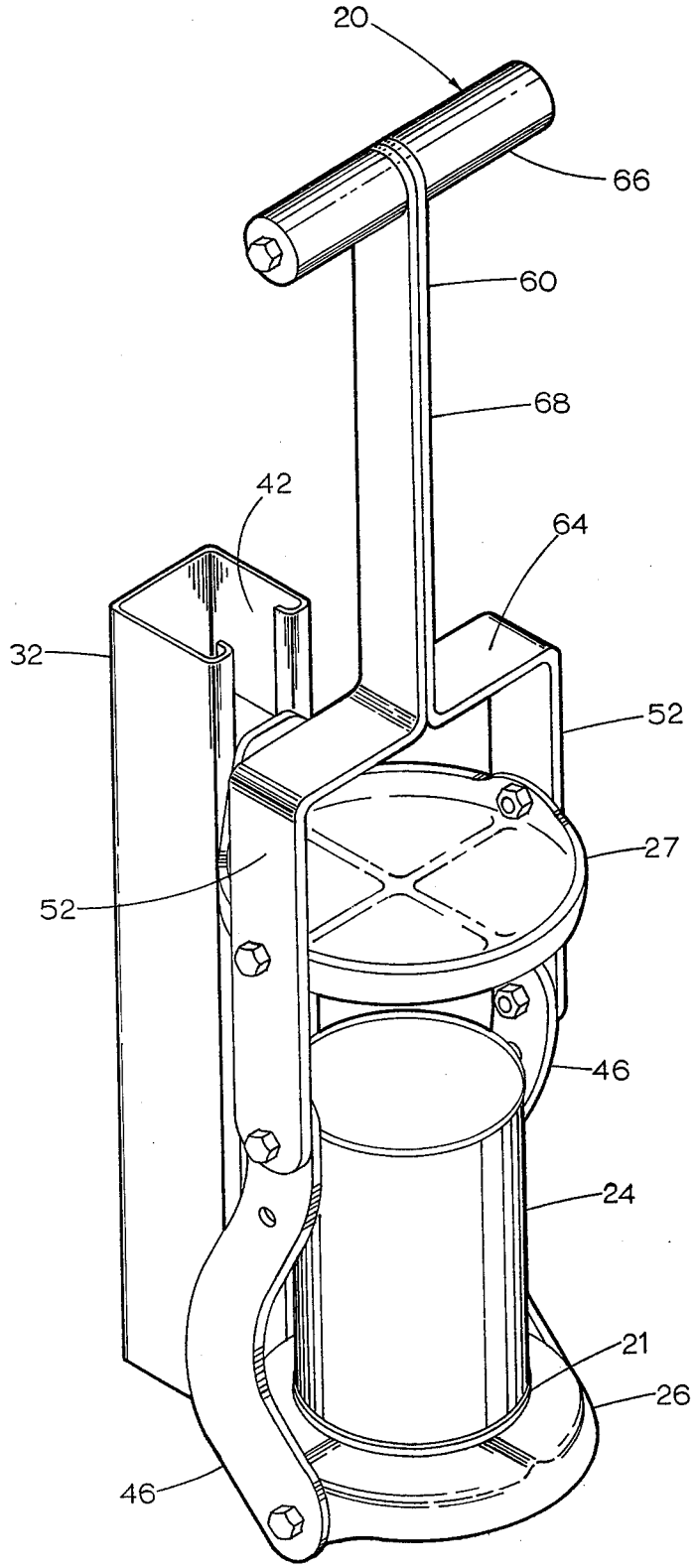
FIG. 1 is a perspective view of an embodiment of the can crusher.
Figure 2:
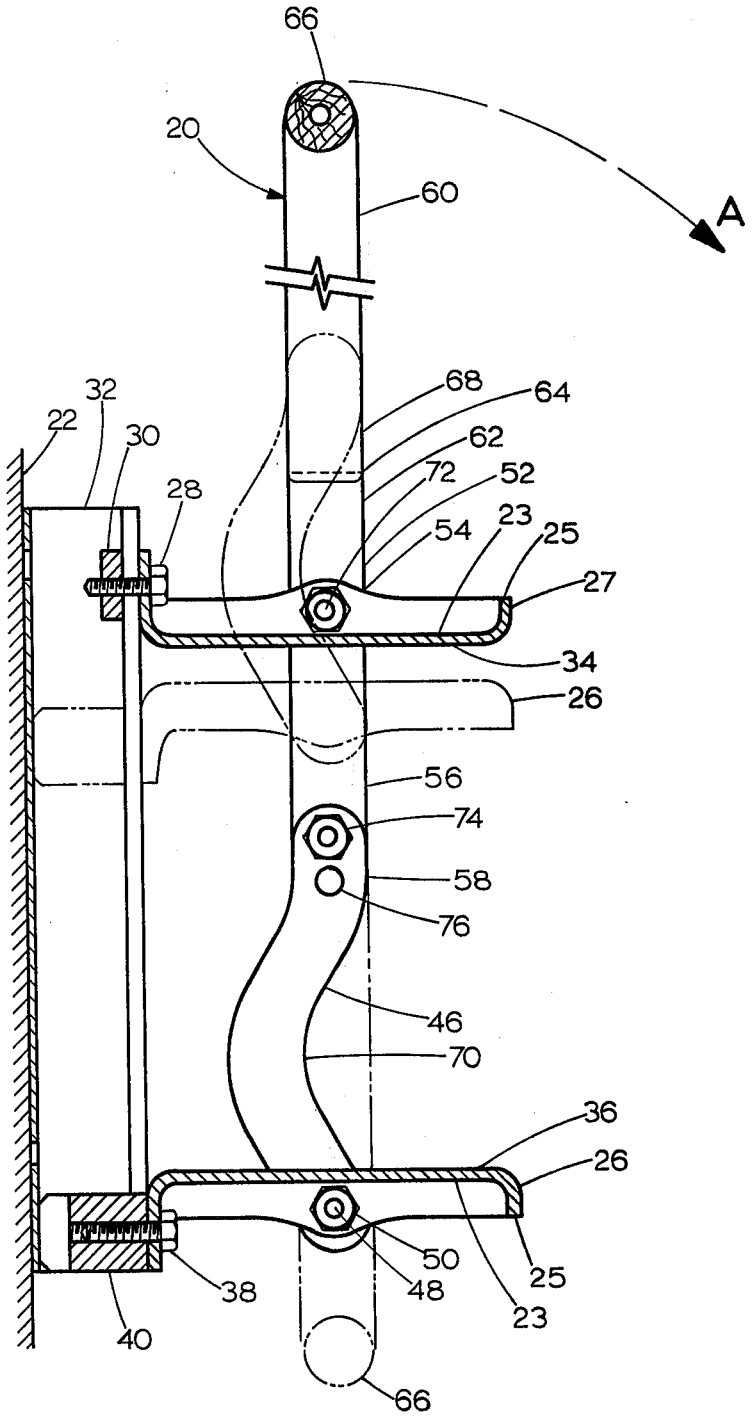
FIG. 2 is a vertical section through the embodiment of the can crusher shown in FIG. 1 with the jaws in the open position and the closed position of the jaws in phantom.
Figure 3:
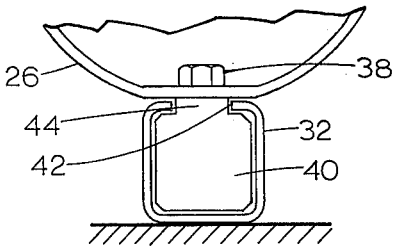
FIG. 3 is a bottom plan view of the track and guide member with part of a jaw shown.

Referring to FIGS. 1 and 2, one form of the can crusher 20 is shown mounted on a wall 22. The can 24 is inserted between two jaws 26 and 27 which may, for example, consist of a plate 23 with or without stiffening structure such as a rim 25. The upper jaw 27 is rigidly attached, as by using a bolt 28 and nut 30 to a track 32 which serves as a base for the crusher 20. The upper jaw 27 is positioned transversely to the track 32 with its face 34 directed toward the lower jaw 26. The face 36 of the lower jaw 26 is positioned transversely to the track also and is in juxtaposition with the face 34 of the upper jaw. The lower jaw is rigidly attached, for example, by the use of a bolt 38, to a guide member 40 which is closely received within the track 32 to be slidably retained within the track. See FIG. 3. The track is formed by a rectangular tube having an opening 42 on one side. The guide member 40 has an approximately rectangular cross section and a raised ridge 44 to which extends through the opening 42 against which the jaw 26 is secured. The guide member slides within the track so that the jaw 26 moves longitudinally along the track so that the jaws may be variably spaced from each other. A pair of lever arms 46 are pivotally attached at one end as by a bolt 48 and nut 50 to opposite sides of the lower jaw 26. A second pair of lever arms 52 are attached similarly at midpoints 54 to the opposite sides of the upper jaw. The ends 56 and 58 of the two lever arms on the same side of the crusher are pivotally attached together on both sides of the can crusher. A handle 60 is attached as by welding to the opposite end 62 of the lever arms 52. The handle cross member 64 connects the lever arms 52 and a grip 66 is attached parallel to the wall to the cross member by a connecting member 68. The connecting member 68, the cross member 64, and lever arms 52 may be integrally made. In operation the grip 66 is pulled down and away from the wall through an arc as indicated by arrow A to the position shown in phantom in FIG. 2. This will cause the lower jaw 26 to assume the position shown in phantom in FIG. 2 near the upper jaw 27. This, when done forcefully, will result in the crushing a container interposed between the jaws.

The lever arms 46 may be bowed at their centers 70 to miss the pivotal connection 72 when the grip is in the lower position.

This form of can crusher allows for easy manual operation. The mounting of the handle 60 transversely to the operator, who would normally stand in front of the can crusher facing the wall, allows grasping the grip 66 with one or both hands.

The downward motion of the handle operation is a motion that is readily accomplished forcefully by an operator without awkward twisting, pushing, or pulling body movements.

The multiple lever configuration gives increased mechanical advantage without requiring a great deal of space for the crusher and results in the highest mechanical advantage at the top and bottom of the stroke. It is at these two points, where the buckling of the can must first be started and where the crushed surfaces contact each other the most, that the most force is required and can by this crusher be most easily provided with lower effort exerted on the handle.

The long 180° movement of the handle allows for a longer stroke with a reduction in force required on the handle to accomplish the same amount of crushing work.

The arrangement particularly lends itself to a vertical wall mounting, eliminating the need to take up valuable horizontal working space such as a table surface and lending itself to a variety of convenient mounting locations. The ability to position the handle above or below the jaws also reduces the amount of apace taken up by the crusher.

Since the minimum distance between the jaws is controlled by the mechanical configuration all containers may be crushed to the same thickness.

ANOTHER EMBODIMENT OF THE TRACK AND GUIDE MEMBER

Figure 4:
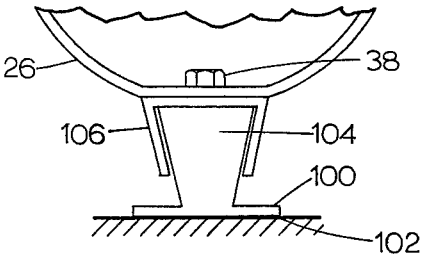
FIG. 4 is a bottom plan view of another embodiment of the track and guide member.

The track and guide member may take on other configuration. As shown in FIG. 4, the track 100 has a base 102 by which it may be attached to the wall 22 and a triangular shaped body 104. The guide member 106 has a "C" shaped cross section which wraps about the body of the track to cause the guide member to be slidably attached to the track.

A THIRD FORM OF THE TRACK AND GUIDE MEMBER UTILIZING A TROLLEY

Figure 8:
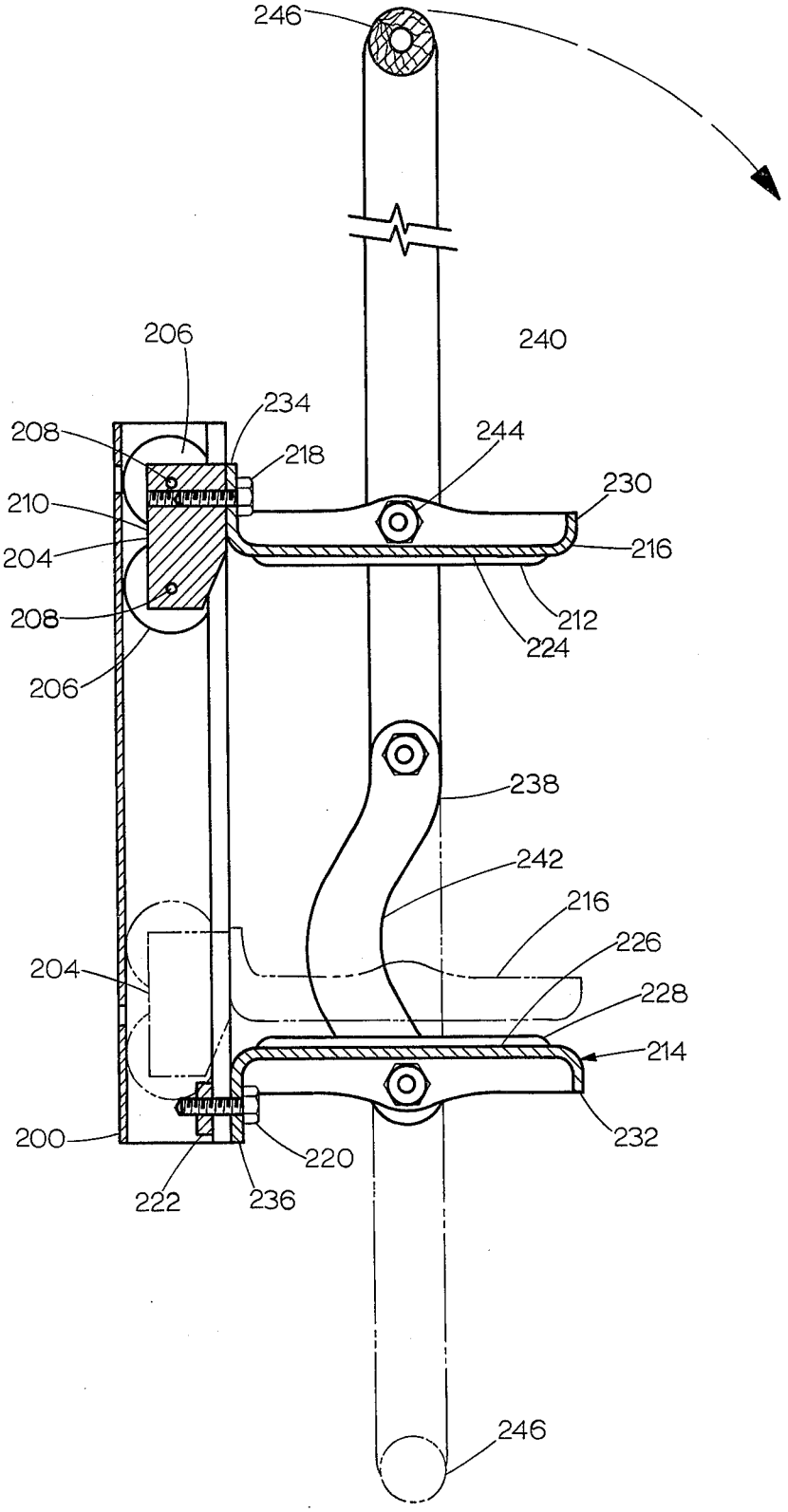
FIG. 8 is a vertical section through the preferred embodiment of the can crusher with the jaws in the open position with the closed position of the jaws in phantom.
Figure 9:
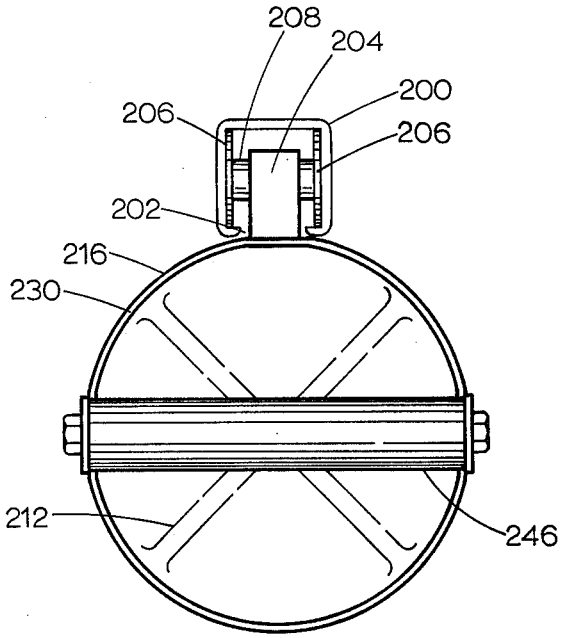
FIG. 9 is a top plan view of the preferred embodiment.

A further configuration of the track and guide member is shown in FIGS. 8 and 9. The track 200 is formed of rectangular tubing having an opening 202 on one surface. The guide is in the form of a trolley 204. Two sets of wheels 206 mounted on axles 208 attached to the body 210 of the trolley. The diameter of the wheels is slightly smaller than the inside dimension of the track so that the individual trolley wheels only contact one surface at a time, but large enough so that the trolley will not twist excessively within the track when opposite wheel surfaces of adjacent wheels contact opposite interior surfaces of the track. This assures smooth operation. The use of the trolley results in a low friction operation of the crusher reducing the amount of effort required to crush a container. It also spreads the load over a greater distance and with two axles maintains the alignment while increasing the strength.

Figure 10:
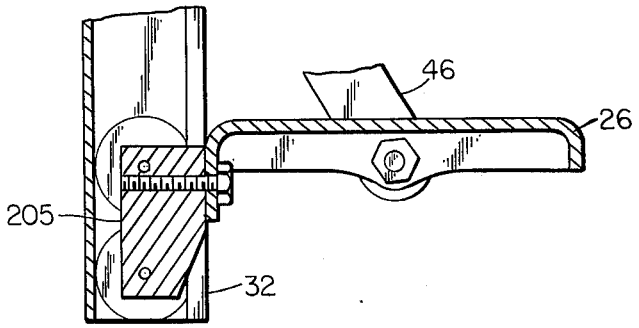
FIG. 10 is a partial vertical section an embodiment of the can crusher similar to that embodiment shown in FIG. 2 using a trolley.

FIG. 10 illustrates the use of a trolley 205 in place of the guide member 40 shown in FIG. 2.

OTHER FORMS OF THE TRACK AND GUIDE MEMBER

The track and guide member may assume other configurations and are not limited to those shown. Variations of these configurations and other configurations may be used in which a guide member is slidably attached to a track.

AN EMBODIMENT OF THE CAN CRUSHER UTILIZING A BOSS ON THE JAW FACE

Figure 6:
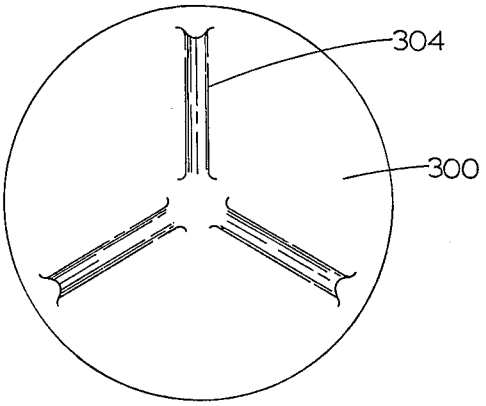
FIG. 6 is a plan view of another form of a boss on a jaw.
Figure 5:
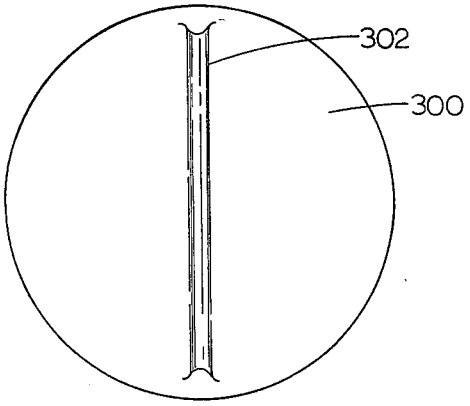
FIG. 5 is a plan view of a form of a boss on a jaw.
Figure 7:
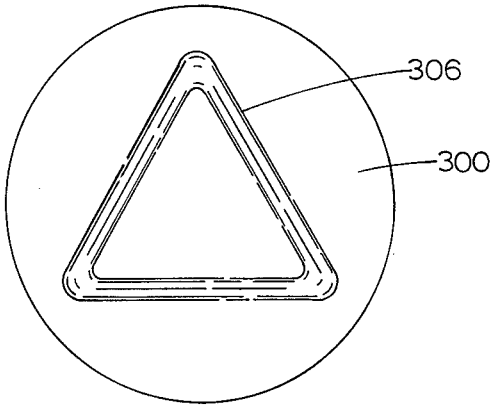
FIG. 7 is a plan view of an alternate form of a boss on a jaw.

The promote the collapsing of the surfaces of the can during crushing, the surfaces of the jaw face 300 are made uneven by the addition of a boss 302, as shown in FIG. 5. The boss may assume many different forms. As shown in FIG. 5, the boss may be in the form of a straight line across the diameter of the face 300. Alternately the boss may be in the form of three nonintersecting radial lines 304 as in FIG. 6, a triangle 306, as in FIG. 7, or a cross 212, as in FIG. 9. Preferably the boss is located on the jaw so that it intersects the rim 21 of the can 24, as shown in FIG. 1, to cause it to buckle and bend during the crushing operation. The one or both jaw faces may have bosses which may be of the same configuration or of differing configurations. The boss or bosses may assume other configurations than those shown such as the form of a square, circle, "V", or parallel lines, for example.

OTHER EMBODIMENTS OF THE CAN CRUSHER

Varying the lengths of the arms 46 and 52 will alter the mechanical advantage and the travel distance of the moving jaw. This may be done by using different length arms or by moving the pivotal connection points such as connection 74 to an alternate connection point, such as provided by holes 76 in the arm 46 shown in FIGS. 1 and 2.

Varying the distance from the grip 66 to the pivot connection 72 will also change the mechanical advantage.

It is not necessary that the lever arms be in pairs, but it is preferred that pairs be used on either side of each jaw to prevent twisting of the mechanism during the operation.

The apparatus shown is adapted for manual operation of the handle but it is not so limited and mechanical actuation of the device is possible.

THE PREFERRED EMBODIMENT OF THE CAN CRUSHER

Referring to FIGS. 8 and 9, the preferred embodiment of the can crusher, the lower jaw 214 is fixed to the track 200 and the upper jaw 216 is attached to a trolley 204. The trolley has four wheels 206 mounted on two axles 208 which permit relatively low friction travel of the trolley inside track 200. The track is a rectangular tube having an opening 202 on one surface. The upper plate is attached by a bolt 218 to the body 210 of the trolley through the opening 202 in the track 200. The lower jaw is attached by a bolt 220 and nut 222 which spans the opening 202 to the track 200. The face 224 of the upper jaw and the face 226 of the lower jaw are transversely aligned to the track and directed towards each other. Each face 224 and 226 carries a boss 212 and 228 respectively in the form of a cross. The jaws 214 and 216 are made of steel stampings so that the bosses 212 and 228 and the stiffening rims 230 and 232 around the perimeter of the jaws and normal to the faces 224 and 226 respectively are formed in one operation. It is through extensions 234 and 236 of these rims that the mounting bolts 218 and 220 pass to attach the jaws to the track and trolley respectively. A lower pair of arms 238 are pivotally attached at their opposite ends to a upper pair of arms 240 which are each attached pivotally at a midpoint to opposite sides of the upper jaw 216. The center 242 of the lower arms are bowed to miss the attachment point 244 of the upper arms to the upper jaw when the crusher is operated. A gripping handle 246 is attached between the upper arms to provide an operating grip.

To operate the device the handle 246 is swung through a downward arc to the position shown in phantom in FIG. 8. The upper jaw 216 moves forcefully toward the lower jaw crushing an interposed container finally reaching the position adjacent the lower jaw shown in phantom.

I claim:

1. A can crusher for reducing such containers to a compact form, comprising:

a. a track in the form of a hollow tube having an opening along one surface to serve as a base for the can crusher;

b. a guide member in the form of a trolley mounted within the track for low friction travel along the track so that the guide member will travel along the track;

c. a first jaw positioned exterior to the track and rigidly and transversely attached to the track;

d. a second jaw positioned exterior to the track and attached to the guide member in juxtaposition and opposed to the first jaw which may be variably spaced from the first;

e. a first lever arm pivotally attached at a first end to the first jaw;

f. a second lever arm pivotally attached at a midpoint to the second jaw and pivotally attached at a first end to the second end of the first lever; and g. means for actuating the can crusher attached to the second end of the second lever so that a can may be inserted between the jaws when the second end of the second lever arm is in a position away from the first jaw and the can crushed between the jaws when the second end of the second lever arm is swung through an arc toward the first jaw causing the jaws to converge.

2. A can crusher for reducing such containers to a compact form, as claimed in claim 1, wherein at least one of the jaws has a boss on its face to create an uneven contact surface with the cans to promote the buckling of the can surfaces during crushing.

3. A can crusher for reducing such containers to a compact form, as claimed in claim 2, wherein the boss forms a cross on the plate face.

4. A can crusher for reducing such containers to a compact form, as claimed in claim 2, wherein the boss is in the form of three non-intersecting radial lines.

5. A can crusher for reducing such containers to a compact form, as claimed in claim 1, comprising, in addition: a third lever arm pivotally attached at a first end to the first jaw opposite the first lever arm and a fourth lever arm pivotally attached at a midpoint to the second jaw opposite the second lever arm and attached at a first end to the second end of the third lever; and wherein the actuating means comprises a handle which is also attached to the second end of the fourth lever arm; whereby the first and third lever arms and the second and fourth lever arms, respectively, form pairs of lever arms to provide rigidity to the apparatus and eliminate torque otherwise placed on the apparatus and the handle provides a grip for manual actuation.

6. A can crusher for reducing such containers to a compact form, as claimed in claim 5, wherein the opposing jaw faces have a centrally located boss in the form of a cross.

7. A can crusher for reducing such containers to a compact form, comprising:

a. a track in the form of a hollow tube having an opening along one surface to serve as a base for the can crusher;

b. a guide member in the form of a trolley mounted within the track for low friction travel along the track such that the guide member will run along the track;

c. a first jaw positioned exterior to the track and attached to the guide member and positioned transversely to the track which may be variably positioned along the track;

d. a second jaw positioned exterior to the track and rigidly and transversely attached to the track in juxtaposition and opposed to the first jaw;

e. a first lever arm pivotally attached at a first end to the first jaw;

f. a second lever arm pivotally attached at a midpoint to the corresponding point of attachment on the second jaw and pivotally attached at a first end to the second end of the first lever arm; and g. means for actuating the can crusher attached to the second end of the second lever arm so that a can may be inserted between the jaw when the second end of the second lever arm is in a position away from the first jaw and the can crushed between the jaws when the second end of the second lever arm is swung through an arc toward the first jaw causing the jaws to converge.

8. A can crusher for reducing such containers to a compact form, as claimed in claim 7, comprising in addition; a third lever arm pivotally attached at a first end to the first jaw opposite the first lever arm and a fourth lever arm pivotally attached at a midpoint to the second jaw opposite the second lever arm and attached at a first end to the second end of the third lever and wherein the actuating means comprises a handle which is also attached to the second end of the fourth lever arm, whereby the first and third lever arms and the second and fourth lever arms, respectively, form pairs of arms to provide rigidity to the apparatus and the handle provides a grip for manual actuation.

9. A can crusher for reducing such containers to a compact form, as claimed in claim 8, wherein the jaw faces have a centrally located boss in the form of a cross.

10. A can crusher for reducing such containers to a compact form, comprising:

a. a track in the form of a hollow tube having an opening along one surface to serve as a base for the can crusher;

b. a guide member in the form of a trolley mounted within the track for low friction travel along the track so that the guide member will travel along the track;

c. a first jaw positioned exterior to the track and having a boss on its face in the form of a cross, the jaw transversely attached to the track;

d. a second jaw positioned exterior to the track and attached to the guide member having a centrally located boss on its face in the form of a cross, the jaw face in juxtaposition and opposition to the first jaw face which second jaw may be variably spaced from the first jaw;

e. a first pair of parallel lever arms pivotally attached at their respective first ends to opposite sides of the first jaw;

f. a second pair of parallel lever arms pivotally each attached at a midpoint to the opposite sides of the second jaw and pivotally attached at their respective first ends to the respective second ends of the corresponding lever in the first pair of lever arms;

g. a handle attached to the second end of the second pair of lever arms so that a can may be inserted between the jaws when the handle is in a position away from the first jaw and the can crushed between the jaws when the handle is swung through an arc toward the first jaw causing the jaws to converge.

* * * * *